US006801723B2

(12) United States Patent
Herrmann et al.

(10) Patent No.: US 6,801,723 B2
(45) Date of Patent: Oct. 5, 2004

(54) IMAGE-FORMING DEVICE HAVING A PATTERNED ROLLER AND A METHOD FOR PROVIDING TRACEABILITY OF PRINTED DOCUMENTS

(75) Inventors: William I. Herrmann, Eagle, ID (US); Bradley J. Anderson, Boise, ID (US); Bruce L. Johnson, Eagle, ID (US); Leonard T. Schroath, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 32 days.

(21) Appl. No.: 10/308,802

(22) Filed: Dec. 2, 2002

(65) Prior Publication Data

US 2004/0105700 A1 Jun. 3, 2004

(51) Int. Cl.[7] ..... G03G 15/00

(52) U.S. Cl. ..... 399/2; 101/32; 399/366

(58) Field of Search ..... 399/2, 159, 366; 101/32

(56) References Cited

U.S. PATENT DOCUMENTS

| | | | | |
|---|---|---|---|---|
| 5,041,359 A | | 8/1991 | Kooi, Johannes | |
| 5,313,256 A | * | 5/1994 | Bov et al. | 399/2 |
| 5,848,346 A | * | 12/1998 | Takashiro | 399/382 |
| 6,095,164 A | * | 8/2000 | Saitoh et al. | 118/500 |
| 6,321,648 B1 | | 11/2001 | Berson et al. | |

FOREIGN PATENT DOCUMENTS

| | | | | |
|---|---|---|---|---|
| EP | 1125758 A1 | | 8/2001 | |
| JP | 08-095444 | * | 4/1996 | G03G/21/00 |
| JP | 2000-175023 | * | 6/2000 | G03G/21/00 |
| JP | 2002-268474 | * | 9/2002 | G03G/21/00 |

* cited by examiner

*Primary Examiner*—Fred Braun

(57) ABSTRACT

A method and apparatus for an image-forming device having at least one patterned roller for affecting the amount of toner present on a print medium when the print medium is advanced through a paper path of the image-forming device and contacts the at least one patterned roller. The roller includes a purposeful pattern that is formed in an outer surface of the roller. The purposeful pattern is configured to form an identifying mark on a print medium as a result of the amount of toner present on the print medium.

20 Claims, 4 Drawing Sheets

IMAGE-FORMING DEVICE HAVING A PATTERNED ROLLER AND A METHOD FOR PROVIDING TRACEABILITY OF PRINTED DOCUMENTS

BACKGROUND OF THE INVENTION

Field of the Invention

The present invention relates to image-forming device and, more particularly, to an image-forming device having a patterned roller that is able to produce a unique, identifying mark on a document.

Devices used to form images, such as laser printers, inkjet printers, photocopiers, fax machines, and scanners, are well known in the art. Images are formed by these devices using various techniques. For example, in laser printers and photocopiers, a latent image is created on an insulating, photoconductive roller by selectively exposing portions of the photoconductive roller to light to form exposed and unexposed portions having different electrostatic charge densities. A visible image is formed using electrostatic toners that are selectively attracted to the exposed or unexposed portions depending on the charge of the photoconductive roller or the toner. A sheet of paper or other print medium having an electrostatic charge opposite to the charge on the toner is passed close to the photoconductive roller. The toner is transferred from the photoconductive roller to the paper, still in the pattern of the image developed from the photoconductive roller. A set of rollers melts and fixes the toner to the paper to produce the printed image.

Image-forming devices are used around the world to print, or otherwise image, documents. As the number of documents produced by these devices increases, it is becoming important to be able to trace or identify the device that produced a particular document. For example, law enforcement officials commonly need to trace a document to prove or disprove that a suspected printer or photocopier was used to produce the document.

Some countries require that imaged documents be traceable to the device that produced them. To provide this traceability, yellow toner has been used to print a serial number or other "fingerprint" on the document. While this technique allows the document to be traced, it requires firmware support to produce the yellow fingerprint, adding to the complexity of the firmware. In addition, this technique increases the consumption of yellow toner, thereby requiring the yellow toner to be replaced more often. Furthermore, the fingerprint interferes with or affects the quality of the image.

Another technique for tracing imaged documents is disclosed in U.S. Pat. No. 6,321,648 to Berson et al., which discloses a method of tagging sheets of recording material. The method comprises applying a random pattern to the recording material. The pattern is present on a roller of an image-forming device, such as a transport roller, and is imprinted or embossed onto the recording material.

BRIEF SUMMARY OF THE INVENTION

A roller for use in a paper path of an image-forming device is disclosed. The roller comprises a purposeful pattern that is formed in an outer surface of the roller. The purposeful pattern is configured to form an identifying mark on a print medium that is transported along the paper path of the image-forming device. The purposeful pattern on the roller affects the amount of toner that is present on the print medium.

A method of producing an identifying mark on a print medium is also disclosed. The method comprises providing an image-forming device that has at least one roller having a purposeful pattern that affects an amount of toner present on the print medium. The print medium is advanced along the paper path and contacted with the roller to form the identifying mark, which is unique to the image-forming device.

BRIEF DESCRIPTION OF THE SEVERAL VIEWS OF THE DRAWINGS

In the drawings, which illustrate various embodiments of the present invention and what is currently considered to be the best mode for carrying out the invention.

DETAILED DESCRIPTION OF THE INVENTION

An image-forming device having at least one patterned roller is disclosed. A print medium is advanced through a paper path of the image-forming device and contacts the at least one patterned roller. The pattern on the roller forms a unique identifying mark on the print medium. Since the identifying mark is unique to the image-forming device, documents are traceable to the image-forming device that imaged them.

Figure 1:
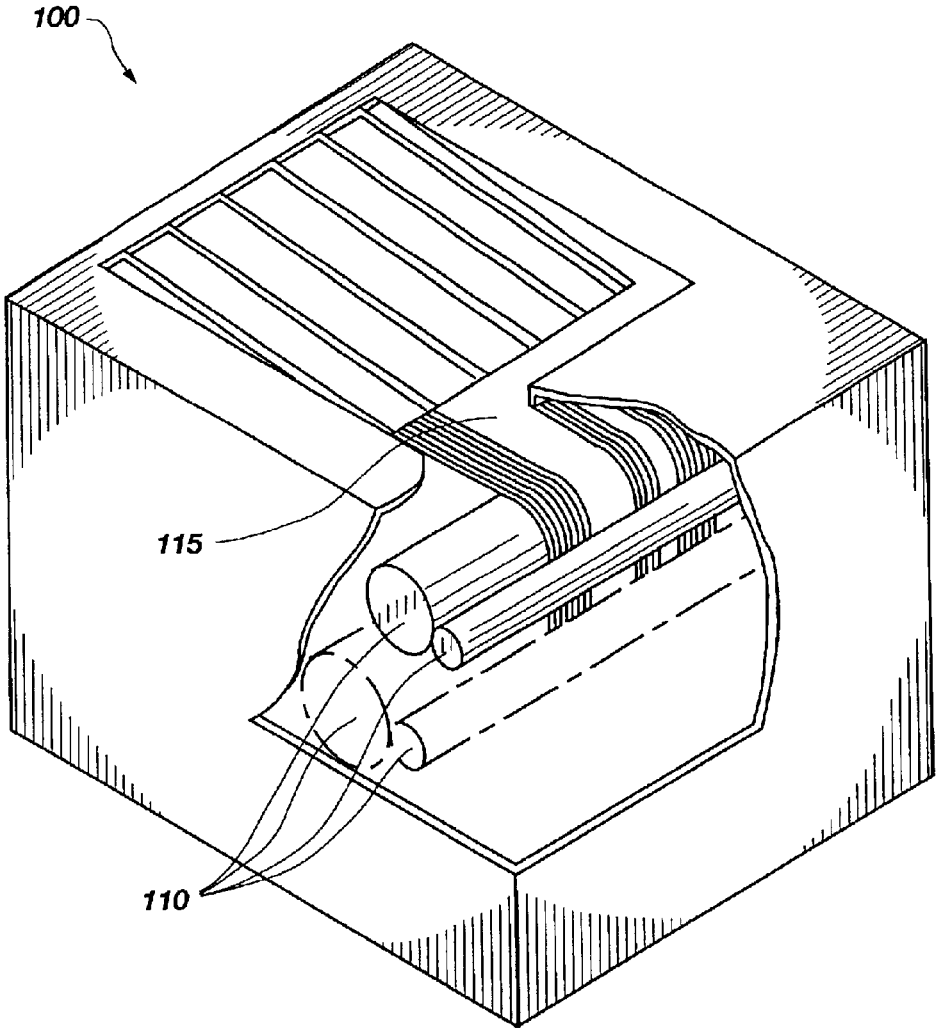
FIG. 1 is a cut away isometric view of an embodiment of a laser printer that shows the paper path and rollers that contact the print medium.

The image-forming device 100 may be any such device that has at least one roller 110 that contacts the print medium 115, as illustrated in FIG. 1. In other words, the roller 110 may be located in the paper path of the image-forming device 100. It is well known that conventional image-forming devices 100 use rollers 110 that contact the print medium 115 to form the desired image on the print medium 115 or to advance the print medium 115 through the paper path. While one embodiment of the image-forming device 100 is described and illustrated herein as a laser printer, it will be understood by those of ordinary skill in the art that the present invention is equally applicable to other image-forming devices 100 that have at least one roller 110 in the paper path, such as other types of printers (i.e., inkjet printers), photocopiers, fax machines, or scanners.

Figure 2:
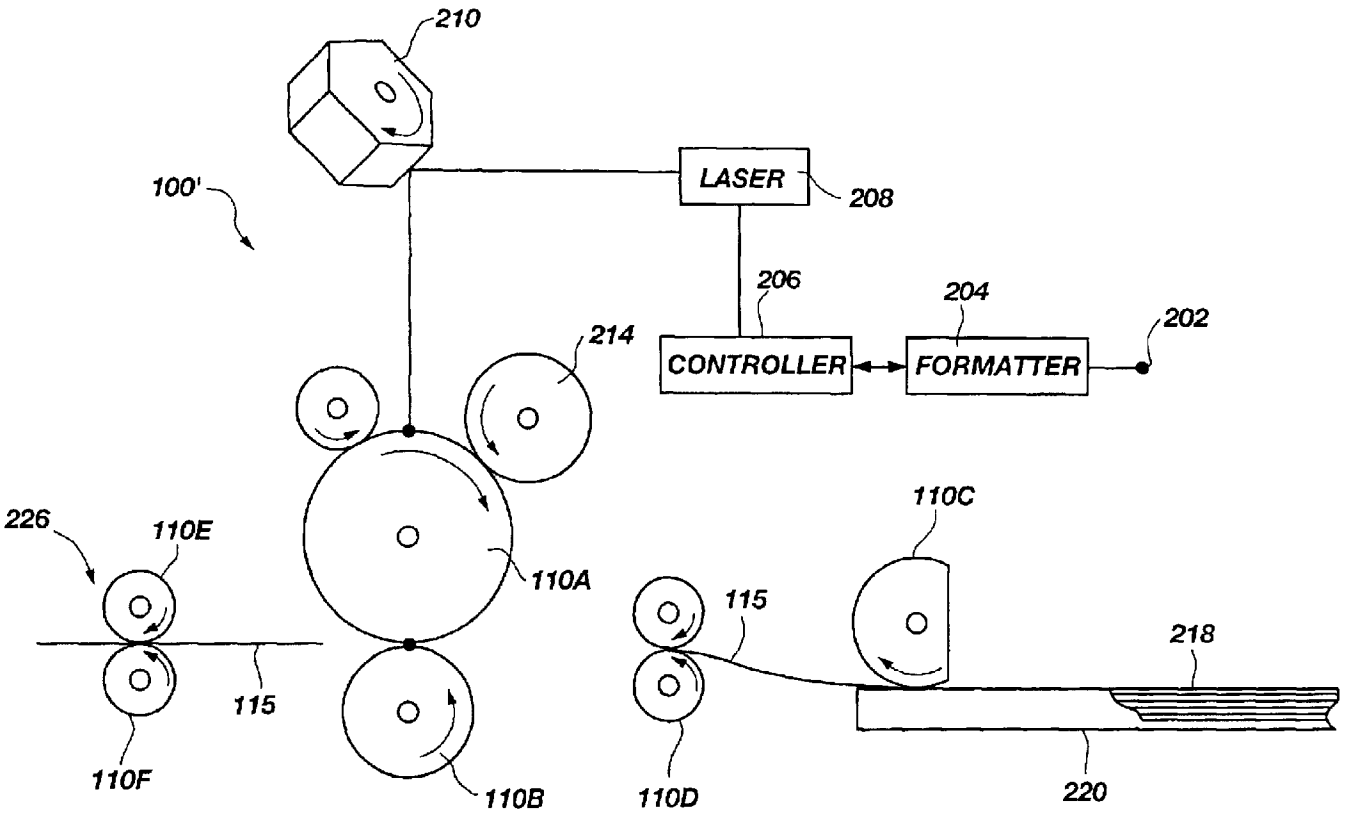
FIG. 2 shows an elevation view of an embodiment of the laser printer and the paper path of the print medium advancing through the laser printer.

In a conventional laser printer, a computer transmits data corresponding to the desired image to be printed to an input port 202 of laser printer 100', as illustrated in FIG. 2. The data is analyzed by formatter 204, which has a microprocessor, related programmable memory and a page buffer. The formatter 204 formulates and stores an electronic representation of each page to be printed. Once a page has been formatted, it is transmitted to the page buffer. The page buffer breaks the electronic page into a series of lines, one dot wide. Each line of data is sent to the printer controller 206. The printer controller 206 drives laser 208 and controls the drive motor(s), fuser temperature and pressure, and other print engine components and operating parameters.

Each line of data is used to modulate the light produced by the laser 208, which is reflected off a multifaceted, spinning mirror 210. Each facet of the mirror 210 spins through the light produced by the laser 208 and reflects or "scans" the light across the side of a photoconductive drum 110A. The photoconductive drum 110A (also referred to herein as imaging roller 110A) rotates so that each successive scan of the light is recorded on photoconductive drum 110A immediately after the previous scan to record each line of data on the photoconductive drum 110A. Toner is electrostatically transferred from developing roller 214 onto photoconductive drum 110A according to the data recorded on the photoconductive drum 110A. The toner is transferred from photoconductive drum 110A to print medium 115 as the print medium 115 passes between photoconductive drum 110A and transfer roller 110B. The print medium 115 is positively charged on its back side, which causes the negatively charged toner to transfer from the transfer roller 110B to the print medium 115 that is passed over the transfer roller 110B. The photoconductive drum 110A is cleaned of excess toner before the next toner transfer, such as when the next sheet of print medium 115 is printed upon.

To print the desired image, each sheet of print medium 115 is transported along a paper path to the imaging roller 110A. A stack 218 of print medium 115 is stored in an input tray 220. A transport roller 110C contacts the upper surface of the topmost print medium 115 to advance the print medium 115 towards the imaging roller 110A. Additional rollers, such as registration rollers 110D, are used to guide the print medium 115 into its proper position for printing. The print medium 115 is advanced through the paper path until it is engaged between imaging roller 110A and transfer roller 110B, where the toner is applied as previously described. The print medium 115 with the applied toner is transported to a fuser 226, which includes a fuser roller 110E and a pressure roller 110F. These two rollers are heated, and when the print medium 115 passes between the rollers 110E and 110F, the toner is fused to the print medium 115 using heat and pressure. The printed document exits the laser printer 100' and is stored in an output source. To exit the laser printer 100', the printed document may use additional transport rollers 110C that are located near the end of the paper path.

The roller 110 used in the image-forming device 100 may be a preexisting roller in the image-forming device 100 that is modified to include a pattern. In other words, the roller 110 may serve additional functions in the image-forming device 100 besides applying the pattern to the print medium 115. For example, the imaging roller 110A or the transport roller 110C may be modified to include a pattern. However, it is also contemplated that the roller 110 may have no other function in the image-forming device 100 other than to transfer the pattern to the print medium. In this situation, the image-forming device 100 may be modified to include an additional roller 110 that is patterned.

Figure 3A:
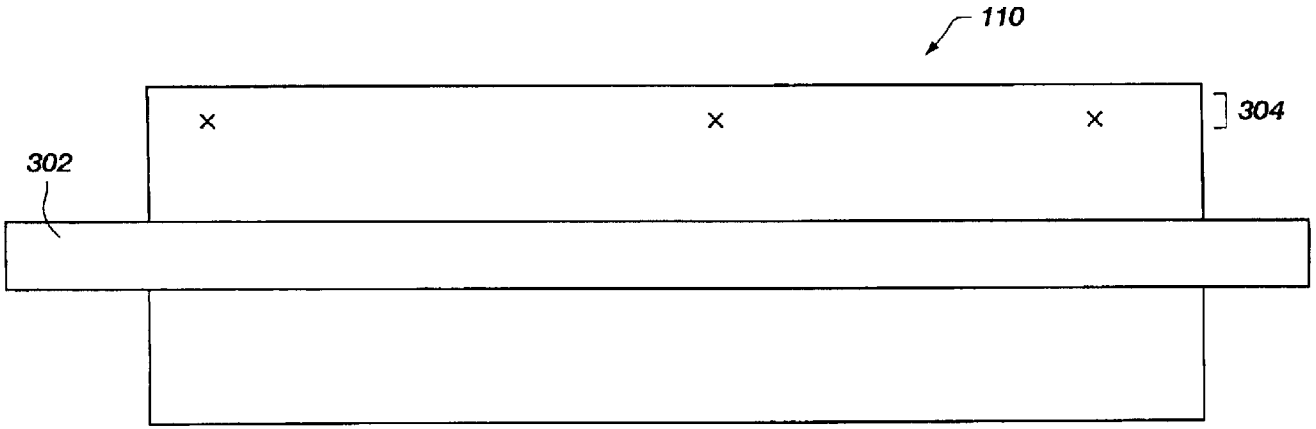
FIGS. 3A and 3B are cross-sectional views of an embodiment of the patterned roller according to the present invention.
Figure 3B:
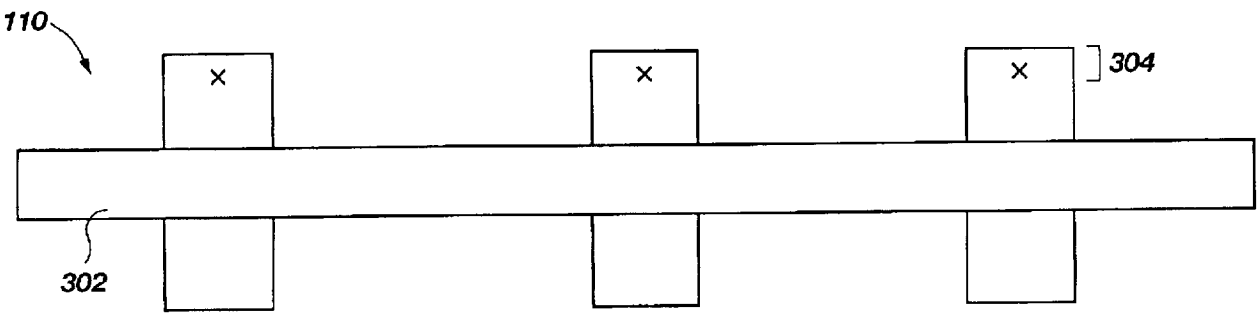

The roller 110 may be cylindrical, as shown in one embodiment in FIGS. 3A and 3B. Rollers 110 used in image-forming devices 100 may hay a diameter ranging from approximately ½ inch to approximately 18 inches, depending on the application. The roller 110 may have a solid length, as shown in FIG 3A, such that the roller 110 spans the entire length or width of the print medium. However, as shown in FIG. 3B, it is also contemplated that multiple rollers 110 may be used to span the print medium. The roller 110 may include a central rotation shaft 302 and may be mounted in the image-forming device 100 such that it rotates about a center axis. The roller 110 may be driven by motors, as known in the art.

Depending on its function in the image-forming device 100, the roller 110 may be formed from a deformable or a resilient material, such as a rubber or an elastomer, or a hard material, such as a metal, ceramic, plastic, or glass. The roller 110 may also be formed from multiple layers of the deformable material and/or the hard material. For example, a pressure roller 110F or a transport roller 110C in a conventional laser printer 100' may have a rubber coating surrounding the central rotation shaft 302 or may have a metal core surrounded by an outer layer of a pliable or deformable material, such as a silicone-type rubber. A fuser roller 110E in a conventional laser printer 100' may have a metal core surrounded by an outer layer of a hard release material, such as TEFLON®. An imaging roller 110A in a conventional laser printer 100' may have a metal core surrounded by a photoelectric coating, such as a coating of selenium.

A pattern 304 may be formed on the roller 110 by conventional techniques for working with the materials used to manufacture the roller 110. For example, the pattern 304 may be etched, laser cut, machined, or mechanically cut into the material of the roller 110. The roller 110 may also be fabricated so that it includes the pattern 304. The patterning of the roller 110 is not discussed in detail herein since the techniques are known in the art.

The pattern 304 on the roller 110 may be used to create a unique, identifying mark 404 (FIG. 4) on the print medium that is used to identify whether imaged documents were produced or created by a particular image-forming device 100. The pattern 304 may be formed on an outer surface of the roller 110 and may include at least one letter, number, or bar-type code of parallel and/or perpendicular lines, or a combination thereof. The pattern 304 may be a purposeful pattern 304, such as a complex design or texture. The term "purposeful" is used herein to refer to a pattern 304 that is deliberate and nonrandom. The pattern 304 may be formed across substantially the entire surface of the roller 110 or on only a portion of the roller 110. It is also contemplated that the pattern 304 may be present on more than one roller 110 in the image-forming device 100. While the patterns 304 on each of the rollers 110 may be the same, one of the rollers 110 may have a first pattern 304 while another of the rollers 110 may have a second, different pattern 304.

Figure 4:
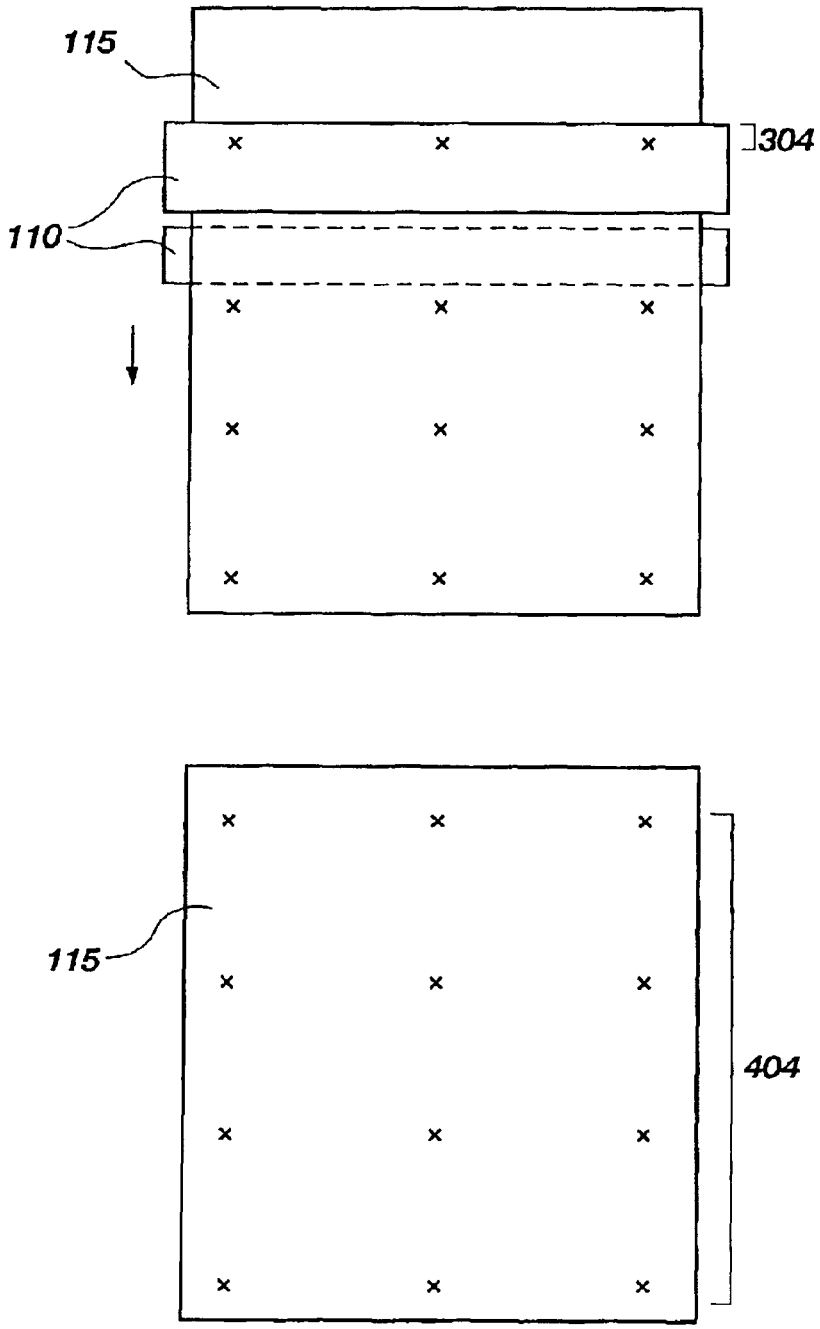
FIG. 4 shows an embodiment of a pattern on the roller and a corresponding identifying mark that is formed on the print medium.

The pattern 304 on the roller 110 may be transferred or applied to the print medium 115 to form the corresponding identifying mark 404 by bringing the print medium 115 into contact with the roller 110, as shown in FIG. 4. The print medium 115 may be passed over or under the roller 110 or between two rollers 110. The roller 110 may produce the identifying mark 404 by pressing or embossing the pattern 304 into the print medium 115. However, the identifying mark 404 may also be produced by adjusting the amount of toner that is present on the print medium 115, as discussed in detail herein. The identifying mark 404 may be applied to the print medium 115 before or after the image is printed. For example, if the patterned roller 110 is positioned earlier in the paper path than the location where the image is formed, the identifying mark 404 may be applied before the image. However, if the patterned roller 110 is positioned after the location where the image is formed, the identifying mark 404 may be applied after the image is formed. In addition, since image-forming devices 100 may use patterned rollers 110 that are positioned both before and after the location where the image is formed, identifying marks 404 may be applied both before and after the image is formed.

As is most clearly shown in FIGS. 1 and 2, the print medium 115 advances along the paper path during the printing process and contacts numerous rollers 110. Any one of these rollers may be patterned to provide the identifying mark 404 on the print medium 115. For the sake of example only, the imaging roller 110A, the transfer roller 110B, the transport roller 110C, the fuser roller 110E, the pressure roller 110F, or one of the registration rollers 110D may be patterned. In addition, any combination of more than one of these rollers may be patterned. For example, the fuser roller 110E and the pressure roller 110F may both be patterned, the transfer roller 110B and the transport roller 110C may both be patterned, or the imaging roller 110A, the registration rollers 110D, and the transport roller 110C may all be patterned. In other words, any combination of rollers 110 that are in the paper path of print medium 115 may be patterned.

Rollers 110A–F may be used in image-forming devices 100 having roller configurations other than those illustrated in FIG. 4, as long as the rollers 110 are in the paper path. For example, laser printers 100' that use transport rollers 110C on both ends of the paper path or that use two pressure rollers 110F are known in the art. In addition, laser printers capable of duplexing (or printing on both sides of the print medium 115) are known in the art. To be able to print on both sides of the print medium 115, duplexers may use a configuration of rollers 110 different than the configuration illustrated in FIG. 2. Each of the rollers 110 in the duplexer that contact the print medium 115 may be patterned.

The pattern 304 in the roller 110 may be selected to produce an identifying mark 404 that has minimal effects on the print quality of the desired image on the print medium 115. The identifying mark 404 may not be visible on the print medium 115 with the naked eye and may only be detectable using magnification means, such as a magnifying glass, a microscope, or the like. For example, a scanning electron microscope may be used to detect the identifying mark 404. Furthermore, applying the identifying mark 404 to the print medium 115 may not substantially affect the surface of the print medium 115 so that the quality of any image printed on the print medium 115 is not affected. Since the surface of the print medium 115 is not affected, the identifying mark 404 may only be a few microns in thickness. However, the identifying mark 404 may be thicker if desired or if the identifying mark 404 is applied on a portion of the print medium 115 where it will not affect the print quality.

To provide the pattern 304 and corresponding unique identifying mark 404 for each image-forming device 100, a sufficient number of patterns 304 and corresponding identifying marks 404 are necessary. Large numbers of patterns 304 may be generated by using various combinations of symbols, numbers, etc. in different orders. A large number of identifying marks 404 may also be created by applying a predetermined pattern 304 to different portions of the print medium 115. The predetermined pattern 304 may be used in more than one image-forming device 100 because the identifying mark 404 corresponding to the pattern 304 may be located in a unique position on the print medium 115. For example, the identifying mark 404 may be located at the center, one of the corners, one of the margins, or any combinations thereof of the print medium 115.

The predetermined pattern 304 may also be repeated at varying intervals on the print medium 115 to produce the identifying mark 404. Since the rollers 110 are cylindrical, the pattern 304 may contact the print medium 115 with every rotation of the roller 110. If the circumference of the roller 110 is smaller than the length of the print medium 115, the identifying mark 404 may be a repeating block of pattern 304, where the pattern 304 is repeated once per rotation of the roller 110. In other words, the pattern 304 is repeated at a multiple of the circumference of the roller 110. By using rollers 110 with different circumferences, the same predetermined pattern 304 may be repeated on the print medium 115 at different distances. For example, if a first image-forming device 100 has a patterned roller 110 with a diameter of ½ inch (corresponding to a circumference of approximately 1.5 inches), the identifying mark 404 may be repeated on the print medium 115 every 1.5 inches. If a second image-forming device 100 uses a roller 110 with the same pattern 304 and a diameter of ¾ inch (corresponding to a circumference of approximately 2.4 inches), the identifying mark 404 may be repeated on the print medium 115 every 2.4 inches. The identifying marks 404 produced by these two image-forming devices 100 may be easily distinguished because the distance between the repeating block of pattern 304 differs.

Depending on a number of rollers 110 in image-forming device 100 that are patterned and the number of symbols, etc. in the pattern 304, the identifying mark 404 may cover substantially the entire surface of the print medium 115, similar to a watermark. Alternatively, the identifying mark 404 may be present only on a portion of the print medium 115, such as in one corner or along the side, top, and/or bottom margins.

The pattern 304 may form a physical identifying mark 404 on the print medium 115, such as an embossed or indented mark. However, the pattern 304 may also form a nonphysical, identifying mark 404 by affecting the amount of toner that is ultimately present on the print medium 115. In other words, the pattern 304 in the roller 110 may cause a different amount of toner to be present on at least selected portions of the print medium 115 than would be present if the pattern 304 was not present. The different amounts of toner present on the print medium 115 form the identifying mark 404 and may be detectable by magnification means. To affect the amount of toner on the print medium 115, the pattern 304 may be formed on the imaging roller 110A, the pressure roller 110F, the fuser roller 110E, or a combination thereof. If the pattern 304 is formed on the imaging roller 110A, an increased amount of toner may adhere to a first portion of the pattern 304 while a decreased or conventional amount of toner may adhere to a second portion of the pattern 304. For the sake of example only, the increased amount of toner may adhere to portions of the pattern 304 that are raised relative to the remainder of the pattern 304 while the decreased or conventional amount of toner may adhere to portions of the pattern 304 that are not raised. When the toner on the imaging roller 110A is transferred to the print medium 115 to produce the desired image, the different amounts of toner are transferred to form the identifying mark 404 corresponding to the pattern 304. The portion of the pattern 304 having the increased amount of toner may produce a portion of the identifying mark 404 that has an increased depth or thickness while the portion of the pattern 304 having the decreased or conventional amount of toner may produce a portion of the identifying mark 404 that has a decreased or normal depth or thickness. The identifying mark 404, which has portions of different thicknesses of toner, may be detected using magnification means. The identifying mark 404 may not be detected by the naked eye and, therefore, does not affect the print quality of the desired image.

Similarly, if the pattern 304 is formed on at least one of the rollers (110E or 110F) in the fuser 226, the pattern 304 may cause the toner to be compressed on certain portions of the print medium 115 as it passes through the fuser 226. For example, raised portions of the pattern 304 may compress the applied toner, thereby reducing the depth or thickness of toner in portions of the identifying mark 404 corresponding to the raised portions of the pattern 304. Nonraised portions of the pattern 304 may not be compressed and, therefore, the depth or thickness of toner in these portions of the identifying mark 404 may not be affected. The identifying mark 404 corresponding to the pattern 304 may be detectable using magnification means to detect the different thicknesses of the toner on the print medium 115.

The identifying mark 404 may be applied to either or both sides (the print side or the nonprint side) of the print medium 115, depending on the configuration of rollers 110 in the image-forming device 100. Image-forming devices 100 may use a pair of rollers 110, where the print medium 115 passes between the two rollers 110. For example, the pair of rollers 110 may be a pressure roller 110F and a fuser roller 110E. One or both of these rollers 110 may be patterned. If one of the rollers 110 is patterned, the identifying mark 404 may be applied to one side of the print medium 115. However, if both rollers 110 are patterned, identifying marks 404 may be applied to both sides of the print medium 115 at substantially the same time. Each of the two rollers 110 may have the same or a different pattern 304. Therefore, each side of the print medium 115 may ultimately have the same or a different identifying mark 404.

Even when only one roller 110 is present, the identifying mark 404 may still be applied to both sides of the print medium 115. For example, if the image-forming device 100 uses a duplexer, the identifying mark 404 may first be formed on one side of the print medium 115. After the print medium 115 goes through the duplexer, the identifying mark 404 may be formed on the reverse side of the print medium 115.

The print medium 115 may be any medium appropriate for use in the image-forming device 100. Since the identifying mark 404 may be embossed into the print medium 115 or formed in the toner on the print medium 115, the print medium 115 may be deformable. However, the print medium 115 may also be sufficiently hard to be capable of maintaining the pattern 304. Print media 115 that are deformable but have a sufficient hardness may include, but are not limited to, paper and transparencies.

When a document needs to be traced to an image-forming device 100, law enforcement officials may compare the identifying mark 404 on the print medium 115 to the pattern 304 on the roller 110 of the image-forming device 100 that is suspected of printing, or otherwise imaging, the document. If the identifying mark 404 matches the pattern 304 on the roller 110, that image-forming device 100 produced the document. In addition to proving that a document was printed by an image-forming device 100, the identifying mark 404 may also be used to disprove that the image-forming device 100 was used. Alternatively, the pattern 304 on the roller 110 of the image-forming device 100 may be linked to the serial number of the image-forming device 100. This information may be stored in a database for use by law enforcement officials.

The ability to apply identifying marks 404 to the print medium 115 may be used in countries where traceability of imaged documents is required, such as in Singapore. Image-fonning devices 100 able to form identifying marks 404 may be specifically produced for use in these countries. For example, an image-forming device 100 may be manufactured to include the patterned roller 110. in addition, an existing image-forming device 100 may be retrofitted to include the patterned roller 110 because rollers 110 in many image-forming devices 100 are easily replaceable. Therefore, the patterned roller 110 may be easily incorporated into the existing image-forming device 100.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A roller for use in a paper path of an image-forming device, comprising:

a cylindrical roller comprising an outer layer; and a purposeful pattern formed in an outer surface of the outer layer, the purposeful pattern configured to form a non-physical identifying mark using an amount of toner on a print medium advancing along the paper path of the image-forming device.

2. The roller of claim 1, wherein the outer layer is formed from one of a deformable material, a resilient material, or a combination of deformable material and resilient material.

3. The roller of claim 1, wherein the purposeful pattern affects an amount of toner that adheres to the roller.

4. The roller of claim 3, wherein a first amount of toner adheres to a first portion of the purposeful pattern and a second amount of toner adheres to a second portion of the purposeful pattern, the first amount of toner being increased relative to the second amount of toner.

5. The roller of claim 1, wherein the purposeful pattern compresses at least a portion of toner applied to the print medium to form the identifying mark.

6. An image-forming device having a paper path, comprising:

at least one roller present in the paper path of the image-forming device, the at least one roller comprising a purposeful pattern, the purposeful pattern configured to form an identifying mark on a print medium advancing along the paper path and for affecting an amount of toner present on the print medium.

7. The image-forming device of claim 6, wherein the purposeful pattern affects an amount of toner that adheres to the at least on roller.

8. The image-forming device of claim 7, wherein a first amount of toner adheres to a first portion of the purposeful pattern and a second amount of toner adheres to a second portion of the purposeful pattern, wherein the first amount of toner is increased relative to the second amount of toner.

9. The image-forming device of claim 6, wherein the purposeful pattern compresses at least a portion of toner present on the print medium.

10. The image-forming device of claim 6, wherein the image-forming device is selected from the group consisting of a laser printer, a photocopier, an inkjet printer, a fax machine, and a scanner.

11. The image-forming device of claim 6, wherein the at least one roller is an image-forming roller, a transport roller, a fuser roller, or a pressure roller.

12. The image-forming device of claim 6, wherein the purposeful pattern is formed in an outer surface of an outer layer of the at least one roller.

13. The image-forming device of claim 6, wherein the roller is formed from one of a deformable material, a resilient material or a combination of deformable material and resilient material.

14. A method of producing an identifying mark on a print medium, comprising:

providing an image-forming device comprising at least one roller having a purposeful pattern, the at least one roller present in a paper path, the purposeful pattern for affecting an amount of toner present on the print medium;

advancing the print medium along the paper path;

contacting the print medium with the at least one roller; and forming the identifying mark on the print medium, the identifying mark unique to the image-forming device, the identifying mark comprising a first amount of toner corresponding to a first portion of the purposeful pattern and a second amount of toner corresponding to a second portion of the purposeful pattern.

15. The method of claim 14, wherein providing an image-forming device comprising at least one roller having a purposeful pattern comprises providing the first portion of the purposeful pattern to which the first amount of toner adheres and the second portion of the purposeful pattern to which the second amount of toner adheres.

16. The method of claim 15, wherein providing an image-forming device comprising at least one roller having a purposeful pattern comprises providing the first portion of the purposeful pattern to which an increased amount of toner adheres relative to an amount of toner that adheres to the second portion of the purposeful pattern.

17. The method of claim 14, wherein providing an image-forming device comprising at least one roller having a purposeful pattern comprises providing the purposeful pattern such that the first portion of the purposeful pattern compresses the first amount of toner on the print medium relative to the second amount of toner.

18. The method of claim 14, wherein forming the identifying mark on the print medium comprises forming a first portion of the identifying mark to have an increased amount of toner relative to an amount of toner on a second portion of the identifying mark.

19. The method of claim 14, further comprising detecting the identifying mark on the print medium by detecting a difference in depth between the first amount of toner and the second amount of toner present on the print medium.

20. The method of claim 14, wherein providing an image-forming device comprising at least one roller in a paper path comprises providing one of a laser printer, a photocopier, an inkjet printer, a fax machine, or a scanner.

* * * * *

UNITED STATES PATENT AND TRADEMARK OFFICE

CERTIFICATE OF CORRECTION

PATENT NO. : 6,801,723 B2
DATED : October 5, 2004
INVENTOR(S) : William I. Herrmann et al.

It is certified that error appears in the above-identified patent and that said Letters Patent is hereby corrected as shown below:

Column 1,
Line 10, after "to" insert -- an --

Column 8,
Line 47, delete "on" and insert therefor -- one --

Signed and Sealed this

Twenty-second Day of February, 2005

JON W. DUDAS
*Director of the United States Patent and Trademark Office*